United States Patent [19]

Tillman

[11] 3,940,195

[45] Feb. 24, 1976

[54] REFRIGERATION CABINET

[75] Inventor: Harry Lucian Tillman, Evansville, Ind.

[73] Assignee: Whirlpool Corporation, Benton Harbor, Mich.

[22] Filed: Oct. 11, 1974

[21] Appl. No.: 514,123

[52] U.S. Cl. ..... 312/214; 220/9 G; 220/9 F

[51] Int. Cl.[2] ..... A47B 81/00

[58] Field of Search ..... 312/214, 236; 220/9 F

[56] References Cited

UNITED STATES PATENTS

| | | | |
|---|---|---|---|
| 3,299,664 | 1/1967 | Booth | 312/236 |
| 3,489,477 | 1/1970 | Harder, Jr. | 312/236 |
| 3,601,463 | 8/1971 | Watt | 312/236 |
| 3,813,137 | 5/1974 | Fellwock et al. | 312/214 |

*Primary Examiner*—Paul R. Gilliam

*Assistant Examiner*—Doris L. Troutman

*Attorney, Agent, or Firm*—Wegner, Stellman, McCord, Wiles & Wood

[57] ABSTRACT

A freezer or refrigerator cabinet having an outer shell for strength and rigidity, a relatively thin plastic liner spaced from the shell to provide an insulating space therebetween with the liner having a projecting portion extending into the insulation space such as one providing a socket for receiving a shelf retainer projection, a thin parting agent sheet enveloping the projecting portion on the side that is within the insulation space with this sheet having an edge area spaced from the projecting portion and attached to the liner so that the sheet encloses the projecting portion and the immediately adjacent portions of the liner to prevent adherent cast resin foam insulation in the space between the shell and the liner from tightly gripping the projecting portion.

7 Claims, 3 Drawing Figures

REFRIGERATION CABINET

BACKGROUND OF THE INVENTION

The cast resin foam insulation that is now common in refrigerator and freezer insulation has the advantage of being strong, adherent to most surfaces, easy to install and with a high insulation value so that the desired degree of insulation can be obtained with relatively small thicknesses of the foam.

These characteristics also, however, create problems in certain instances. Thus where there are extremes of contraction and expansion under changing thermal conditions the adherence can create high stress in certain areas such as those in which the relatively thin plastic liner has one or more projecting portions such as the above-mentioned shelf retainer means due to locking of the liner in recesses in the foam formed by such projections even when the liner surface facing the foam is provided with a laminate release layer as disclosed in copending Weiss et al. application Ser. No. 502,006, filed Aug. 30, 1974, (PA-4800) and assigned to the assignee of the present application. This close fit of the insulation foam resists movement between liner and foam during contraction and expansion due to differences in the coefficient of thermal expansion of the liner material and the insulating foam.

One of the features of this invention therefore is to provide an improved freezer cabinet in which changes in temperature with resulting excessive stress being placed on the liner in normal construction but with this invention cushioning areas that would normally be subject to high stresses with the result that the thermal changes that the freezer cabinet and particularly the plastic liner undergo will not damage the liner.

DESCRIPTION OF THE PRIOR ART

The most pertinent prior art of which applicant is aware is his prior U.S. Pat. No. 3,813,137 and the references cited therein. In this reference there is the disclosure of parting agent films at spaced areas of the insulation foam but the combinations disclosed in these prior patents are different from the inventions disclosed and claimed herein as will be apparent from the following description of this invention.

DESCRIPTION OF THE PREFERRED EMBODIMENT

Figure 1:
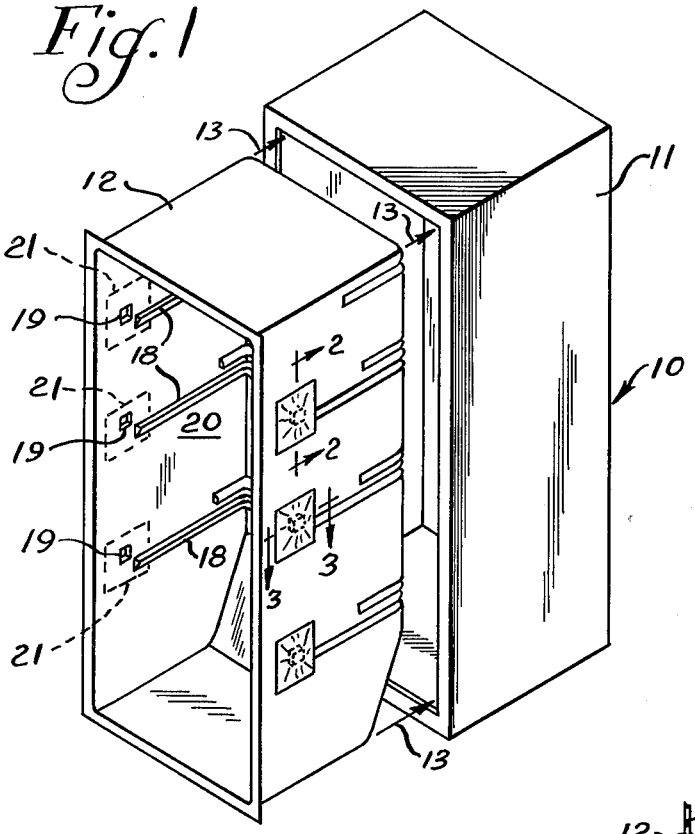
FIG. 1 is a perspective view illustrating a freezer cabinet shell and its relatively thin plastic liner separated from each other for illustrative purposes.

The cabinet 10 which is illustrated in FIG. 1 with the outer shell 11 and plastic inner liner 12 disassembled but capable of being assembled together by movement of the liner into the shell as illustrated by the arrows 13 is assembled as illustrated so that the space 14 between the shell and liner serves as an insulation space to receive the rigid cast resin foam 15. One such foam that is widely used in this type of construction is rigid polyurethane foam which has excellent insulation properties and is strongly adherent to the customary surfaces with which it comes in contact and which may be foamed in place so as to adapt itself to the contours of the surfaces with which it comes in contact.

The inner liner body 12 is preferably a relatively thin plastic resin of the type widely used in this art and includes acrylonitrile butadiene styrene (ABS) copolymer, modified polystyrene, polyolefins such as polyethylene and polypropylene, vinyl chloride polymers and the like. A parting or release layer 12' which may be polyethylene is laminated to the liner 12 prior to the vacuum forming as taught in copending application of Weiss et al. Ser. No. 502,006, filed Aug. 30, 1974 (PA-4800) assigned to the same assignee as the present application. This parting layer 12' serves to preclude firm bonding of polyurethane foam to the liner surface 17 facing insulation 15. The foam however is firmly bonded surface 16 of the shell 11.

Figure 2:
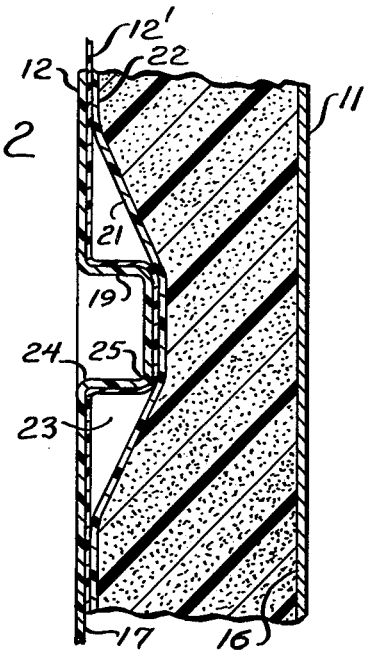
FIG. 2 is an enlarged fragmentary sectional view through the assembled cabinet itself and substantially coinciding with line 2—2 of FIG. 1 on the liner.
Figure 3:
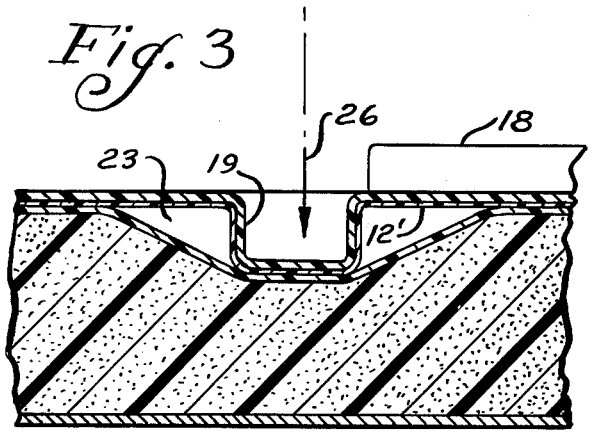
FIG. 3 is a view similar to FIG. 2 but substantially coinciding with line 3—3.

Freezer or refrigerator cabinets of the type illustrated are often provided with inwardly projecting portions 18 that form parts of the liner 12 for retaining article supporting shelves (not shown) in the customary manner. In order to retain these shelves in position there is provided adjacent the outer end of each projecting portion shelf support 18 a projecting portion 19 shown in enlarged detail in FIGS. 2 and 3 and that is shaped as a well or sump. These projecting portions 19 are used in this embodiment for securing shelf retainers for the shelves that are normally supported on the projecting portion supports 18. One suitable shelf retainer is disclosed in copending Winterheimer application Ser. No. 404,191, filed Oct. 9, 1973 and assigned to the assignee of the present application. These retainer portions 19 project into the insulation space 14.

Because of the extreme temperature changes that the liner 12 is subjected to in a freezer cabinet as well as during the manufacture and shipment of the freezer as illustrated there is a tendency for the expansion and contraction particularly at the inwardly extending projections 19 to cause such stresses in the liner 12 as to cause damage apparently due to mechanical "locking" of the liner in foam recess even though the laminate release or parting layer 12' prevents firm adhesion of the foam to the liner. In order to avoid this there are provided at each projection 19 that extends into the insulation space 14 a thin parting sheet 21 that envelops each portion 19 and that has an edge 22 area spaced from the portion 19 and adhered by a suitable adhesive to the inner surface of the liner 12. This sheet 21 is preferably stretched over the projection 19 by applying the individual sheet portions or patches 21 and adhered at the marginal edges 22.

The parting sheet 21 to which the resin foam and particularly the polyurethane foam is relatively nonadherent may be made of polyethylene as noted above or polypropylene or other suitable polyolefin or may be kraft paper or the like all of which are well known in this art. Alternately, the parting sheets 21 may comprise adhesive backed polyethylene film.

The parting agent sheets or patches 21 encloses the projections 19 and the immediately adjacent portions of the liner 12 as illustrated and also a surrounding air space 23 which operates as a resilient cushion space that permits relative movement between the liner and the insulation in the areas of the projecting portions 19. These sheets 21 also prevents the insulation from closely embracing the inwardly extending projections 19 and thereby tightly grasping them which would cause fractures of the liner 12 under thermal stresses particularly at the areas of stress concentration such as the corners 24 and 25.

Having described the invention, the embodiments of the invention in which an exclusive property or privilege is claimed are defined as follows:

1. A refrigeration cabinet comprising: an outer shell; a relatively thin plastic liner spaced from said shell to provide an insulating space therebetween, said liner having a projecting portion extending into said insulating space; cast resin foam insulation filling said insulating space between said shell and liner; and a thin parting agent sheet overlying said projecting portion and having an edge area spaced from said projecting portion and attached to said liner to define a surrounding space about said projecting portion for preventing said cast resin foam from closely embracing said projecting portion.

2. The cabinet of claim 1 wherein said parting agent sheet comprises a flexible polymeric material.

3. The cabinet of claim 1 wherein said sheet is taut and encloses an air space operating as a resilient cushion space permitting relative movement between the liner and the insulation in the area of said projecting portion.

4. The cabinet of claim 1 wherein said projecting portion forms a well for receiving shelf retainer means.

5. The cabinet of claim 1 wherein said parting agent sheet comprises a flexible adhesive backed polymeric material and wherein said sheet is taut and encloses resiliently an air space operating as a resilient cushion space permitting relative movement between the liner and the insulation in the area of said projecting portion.

6. The method of making a refrigeration cabinet, comprising: providing an outer cabinet shell; providing a relatively thin plastic liner spaced from the shell defining an insulation space therebetween, the liner having a projecting portion that projects into said space; enclosing said projection on the surface of said liner that faces said insulation space with a thin parting material sheet by attaching a peripheral portion of said sheet to the inner liner surface at a peripherally closed area spaced from and surrounding said projection to provide a resilient cushion space between the liner and the sheet and to enclose said projection; and applying a cast resin foam insulation in said space between the shell and the liner.

7. The method of claim 6 wherein said parting agent sheet is tautly drawn over said projection in said attaching.

* * * * *